United States Patent [19]

Niemann

[11] Patent Number: 4,583,644

[45] Date of Patent: Apr. 22, 1986

[54] FRUIT SIZER

[76] Inventor: Gary O. Niemann, 3204 E. Lake Hartridge Dr. NW., Winter Haven, Fla. 33880

[21] Appl. No.: 435,545

[22] Filed: Oct. 21, 1982

[51] Int. Cl.[4] ..... B07B 13/05

[52] U.S. Cl. ..... 209/660; 198/839; 209/663

[58] Field of Search ..... 209/692, 912, 919, 923, 209/663, 620, 622, 660, 661, 665; 198/804, 842, 445, 570, 839

[56] References Cited

U.S. PATENT DOCUMENTS

| | | | |
|---|---|---|---|
| 943,799 | 12/1909 | Stebler | 209/663 |
| 1,680,880 | 8/1928 | Hartrampf et al. | 209/933 |
| 3,923,148 | 12/1975 | Dorner | 198/570 |
| 4,217,981 | 8/1980 | Briggs | 198/839 |
| 4,267,930 | 5/1981 | Melkonian et al. | 209/692 |
| 4,279,346 | 7/1981 | McClure et al. | 209/923 |

*Primary Examiner*—David A. Scherbel
*Assistant Examiner*—Donald T. Hajec
*Attorney, Agent, or Firm*—Berman, Aisenberg & Platt

[57] ABSTRACT

A fruit sizer employs an in-feed chute which divides fruit among a plurality of sizing runs evenly. This is accomplished by locating the apices of the dividers with respect to a grade table, or other feed mechanism, so that the fruit is divided evenly. A conveyor system uses slanted rollers which are arranged with respect to a drive roller so that each side of the conveyor belt is placed in tension equal to that of the other side of the conveyor belt. This arrangement prevents undue stress on the conveyor belt and prevents the tendency to walk off the rollers. The sizing rollers are driven by a drive train which employs a single flexible belt and may be raised or lowered with the sizing rollers, without affecting the driving belt.

2 Claims, 9 Drawing Figures

FIG. 2
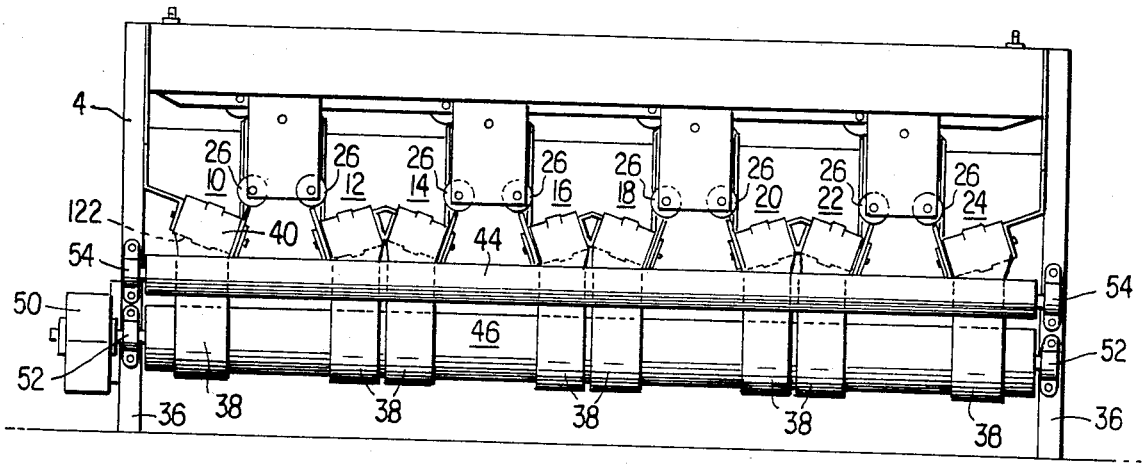
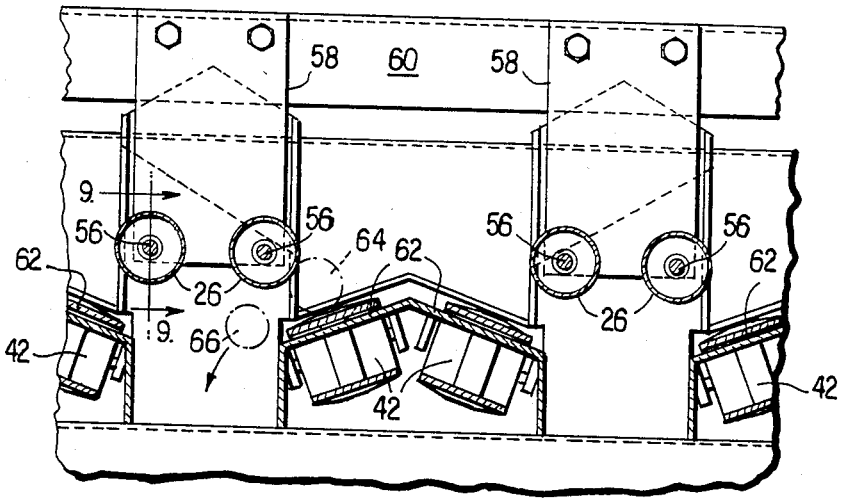
FIG. 3

FRUIT SIZER

TECHNICAL FIELD

This invention relates to the art of fruit sizers.

BACKGROUND ART

A fruit sizer is used to automatically separate fruit according to its size. Typically, the sizer is used in conjunction with a grade table so that the outlet of the grade table connects to the inlet of the sizer. The grade table is used to allow human graders to cull out damaged fruit. A sizer, on the other hand, does not require human input so that and the sizing is done automatically.

The conventional sizer comprises a plurality of parallel conveyor paths which carry fruit from one end of the sizer to the other. As the fruit is carried along the conveyor belt, it comes into contact with a sizing roller which is spaced from the conveyor belt by an amount equal to the maximum size of the fruit desired to be separated from the remainder of the fruit. The roller rotates in a direction to push fruit out of the gap between the sizing roller and the conveyor, thus acting to jostle the fruit to ensure that all pieces of fruit eventually confront the gap between the sizing roller and the belt. When a piece of fruit is smaller than this gap, it falls through the gap and is carried away from the sizer by any of several known means, such as a second conveyor located below the sizer.

The prior art sizers employ a conveyor path which is tilted with respect to the horizontal so that the fruit is continually urged against the sizing roller, and so that the fruit falls between the gap under the force of gravity. This has created a problem in the prior art sizer since the roller which drives the conveyor belt rotates about a horizontal axis, resulting in a twist in the conveyor belt. This twist creates an uneven strain on the belt, resulting in the belt's movement off of the rollers, and this movement is prevented by allowing one edge of the belt to rub against a stop. This constant rubbing between the belt and the stop causes great wear on the belt, resulting in a reduced lifetime.

The conventional drive mechanism for rotating the sizing rollers includes a driving pulley which operates through a plurality of separate chains to drive the sizing rollers. This mechanism is clumsy and requires numerous sprockets and chains which require lubrication.

SUMMARY OF THE INVENTION

The feature of the invention is a conveyor system which is arranged to prevent the stresses on the belt due to the twisting employed in the prior art. The belts of the invention pass over a roller at each end of a conveyor path, and the rollers are angled with respect to a drive roller and are parallel with the conveyor path. The conveyor belt rollers are situated with respect to the drive rollers so that the belt twist causes equal tension on both sides of the belt, resulting in a tendency of the belt to remain centered with respect to the rollers. This means that the belt does not rub up against a stop, as in the prior art, and the lifetime of the belt is extended.

The drive arrangement of the inventive sizer employs a plurality of idler pulleys located above the plurality of sizing rollers. By this arrangement, a single belt may be employed to connect the drive pulley to the idler pulleys and the sizing rollers. This results in a more simple arrangement which requires less maintenance and results in a smooher operation of the drive train.

The in-feed chute of the inventive sizer is arranged to accommodate standard or conventinal grade tables and to distribute the fruit from these grade tables evenly among the sizing paths. Dividers are arranged with respect to the conventional grade table for use with an eight run sizer so that each of two paths receives one-quarter of the grade table output, while two central paths receive one-half of the grade table output. A sizer having a different number of runs will apply the same principle.

It is an object of this invention to provide a fruit sizer having a tilted conveyor path which does not damage the conveyor belts.

It is a further object of this invention to provide a fruit sizer having a drive train capable of using a single flexible belt.

It is another object of this invention to provide an in-feed chute for a fruit sizer which distributes fruit evenly from a grade table.

BRIEF DESCRIPTION OF THE DRAWINGS

FIG. 2 is an end view of the sizer of the invention.

FIG. 3 is a partial cross-section of the sizing paths of the invention, taken along line 3—3 of FIG. 1.

DETAILED DESCRIPTION OF THE DRAWINGS

Figure 1:
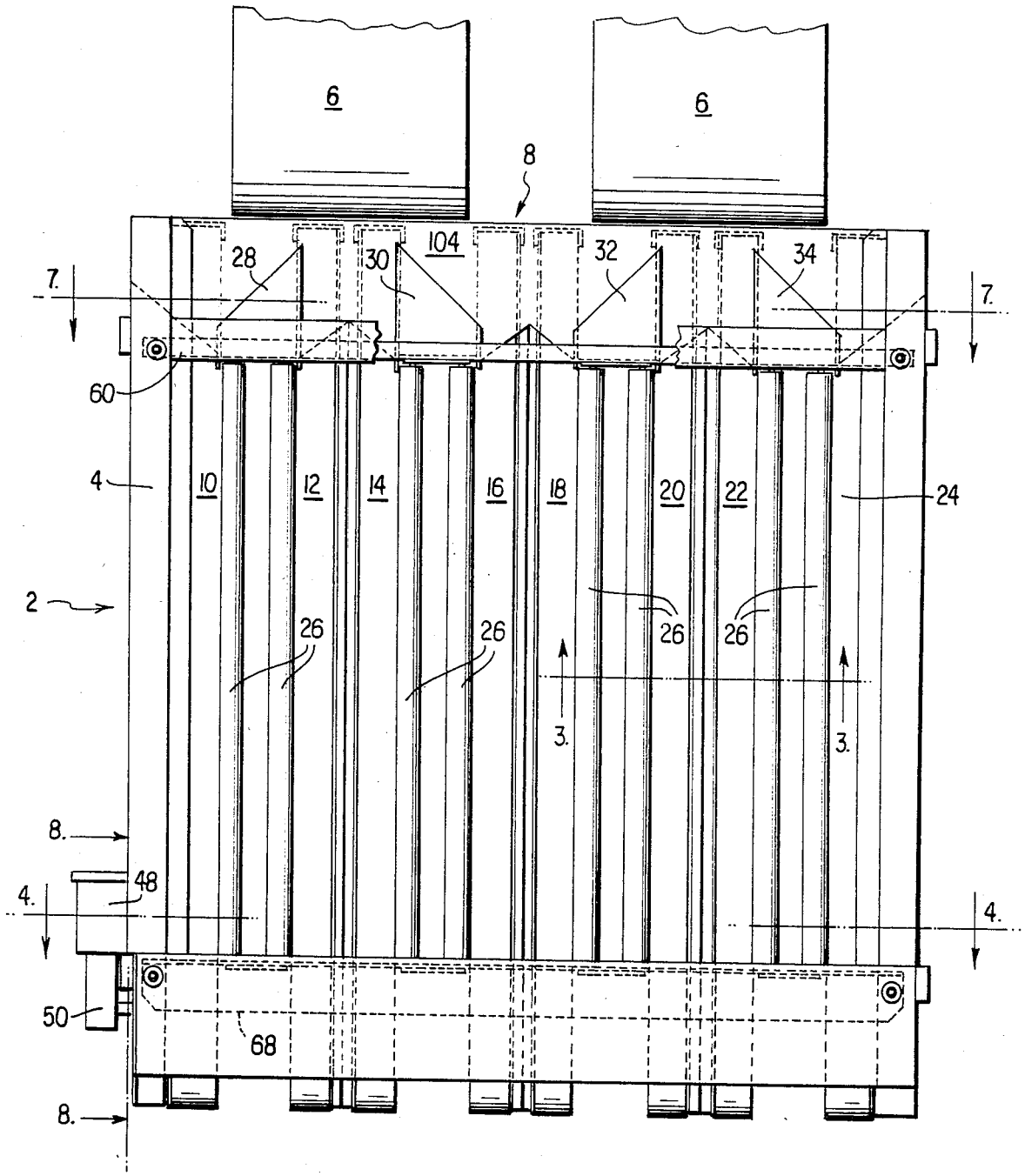
FIG. 1 is a plan view of the sizer of the invention.

Fruit sizer 2 is shown in plan view in FIG. 1. The sizer includes a base member 4 which supports a number of elements which define a plurality of sizing paths. Grade tables 6 direct fruit to an in-feed chute 8 at one end of the sizer. A prior art grade table is typically narrower than a sizer because the grade table should be no wider than an arm's reach of a person culling out damaged fruit as it passes along the grade table. FIG. 1 shows two grade tables which allow a person to sit at each grade table, and a space is shown between the tables. The grade tables could be a single wide conveyor table having a divider down the middle to block off the region which is shown as a space between separate tables 6 in FIG. 1.

Fruit from the grade tables 6 is directed to the in-feed chute 8, and then to the pluraity of sizing runs 10, 12, 14, 16, 18, 20, 22, and 24. Each of these sizing runs includes a sizing roller 26 which will be more fully described below.

An important part of the invention is the separators 28, 30, 32, and 34 which serve to divide the fruit from the grade tables 6 among the sizing runs 10–24. As may be seen from FIG. 1, each separator has an apex which acts to divide fruit into two paths. The width of the divider is arranged with respect to the width of the grade table so that spacing between the apex of separator 28 and the left edge of the left grade table (as seen in FIG. 1) is approximately one-half the spacing between the apex of separator 28 and the apex of separator 30. The distance between the apex of the separator 30 and the right edge of the left grade table 6 is also approximately one-half the distance between the apex of the separator 28 and the apex of the separator 30. This arrangement ensures that one-quarter of the fruit from the grade table 6 will be directed to sizing run 10, one-half of the fruit from the grade table will be directed to sizing runs 12 and 14 and will be thereby separated evenly between each of these runs, and one-quarter of the fruit will be directed to sizing run 16. A similar division of fruit will occur for the fruit arriving from the right grade table 6, caused by the separators 32 and 34. Thus, the fruit will be evenly divided among the eight sizing runs.

The separator concept may be applied to a sizer having any number of runs. If the sizer has 10 runs, the separator will direct one tenth of the fruit to the outside run and one fifth to a set of adjacent runs. The optimum spacing is determined by considering the edge of the grade table to be spaced inwardly fron the actual edge of the average radius of the fruit.

FIG. 2 is an end view of the sizer showing the frame 4 which includes legs 36 to support the sizer on a horizontal surface. Each of the sizing runs, 10 through 24, includes a flexible belt which extends from a slanted roller 40 at one end of the run to a similarly slanted roller 42 (see FIG. 3) at the other end of the run. The flexible belt 38 extends from the roller 40 around an idler roller 44 and around a drive roller 46 (see FIG. 8). The drive roller 46 is driven by a motor 48 (see FIG. 1) which is connected to a gear box 50 which is in turn connected to the drive roller 46. The drive roller 46 is supported at each end by a pillow block 52. Similarly, the other roller 44 is supported by pillow blocks 54.

FIG. 3 shows how the sizing rollers 26 are supported on stationary shafts 56, and how these shafts are supported by end plates 58. A horizontal beam 60 spans the sizer and is supported by the base 4 by adustable means which is more clearly shown in FIG. 7. The flexible belts 38 ride over pins 62 which are inclined with respect to the horizontal and which are supported by the base 4. FIG. 3 shows a piece of fruit 64, diagramatically, which is too large to pass through the gap between the flexible belt 38 and the sizing roller 26, and a piece of fruit 66 which is small enough to have passed through the gap. It is thus see how the sizer operates to separate smaller fruit from larger fruit.

Figure 4:
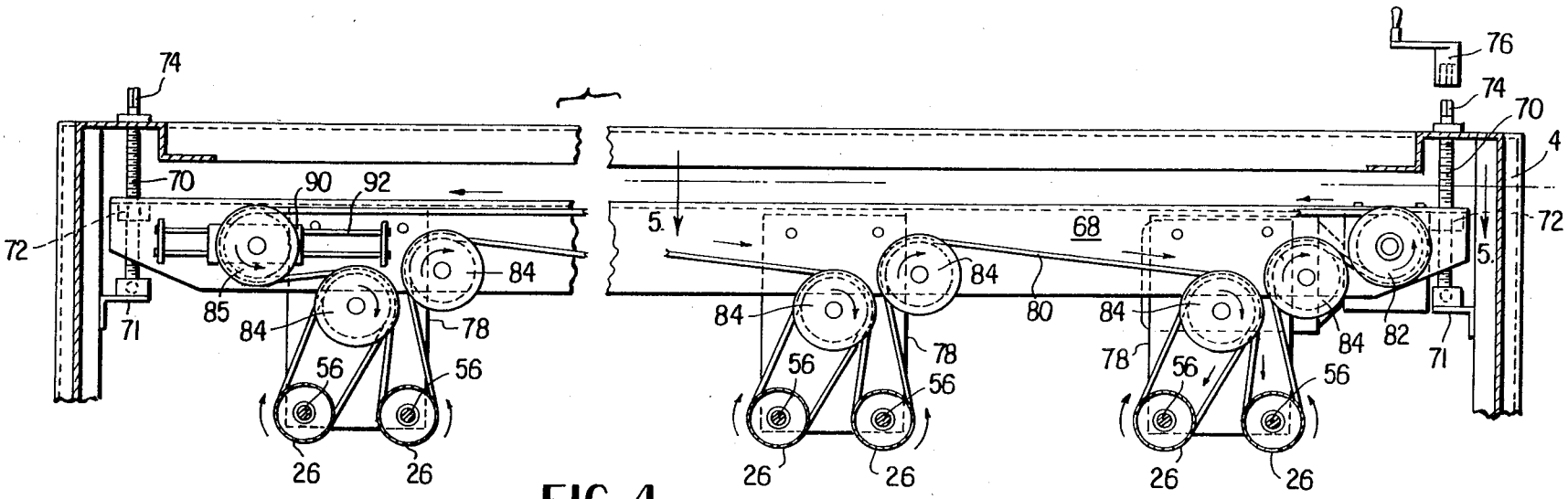
FIG. 4 is a broken cross-section of the sizer taken along line 4—4 of FIG. 1, and showing the inventive drive train.
Figure 5:
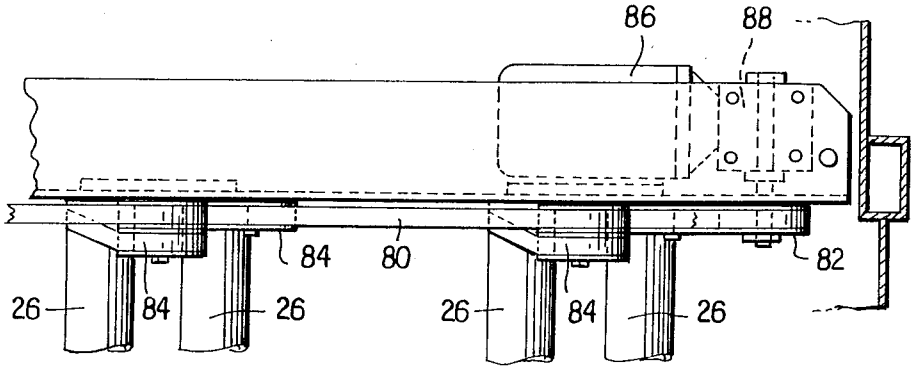
FIG. 5 is a partial cross-section of the drive train taken along line 5—5 of FIG. 4.
Figure 6:
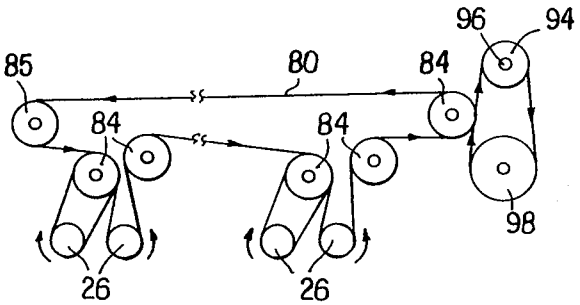
FIG. 6 is a schematic view of a second embodiment of a drive train according to the invention.

FIGS. 4, 5 and 6 show the drive system for rotating the sizing rollers 26, and a second embodiment thereof. The elevation view shown in FIG. 4 shows a horizontal beam 68 suppoted by parallel threaded rods 70 at each end which mate with nuts 72 in the beam 68. Each of the threaded rods 70 is supported by a collar having a thrust bearing at one end and is aligned by a bracket 71. An end 74 may cooperate with a wrench 76 for rotation of the threaded shaft. Rotation of the threaded rods 70 raises or lowers the beam 68 which, in turn, raises or lowers the sizing rollers 26, to thereby adjust the gap between the sizing roller and the flexible belt to determine the size of fruit passing through the gap. Rollers 26 are supported on stationary shafts 56, and one end of each stationary shaft 56 is supported at end plates 78 which are attached to the beam 68. The stationary shafts 56, tie beams 60 and 68 together to make a rigid structure.

The sizing rollers 26 are divided by a flexible belt 80, which may be a single continuous belt. The belt is driven by a drive pulley 82, and a plurality of idler pulleys 84 direct the flexible belt to the sizing rollers 26. An end pulley 85 places the belt in tension as described below. The drive pulley is rotated in a direction so that the sizing rollers act to push fruit away from the gap, otherwise the fruit would be forced through the gap and the sizer would not operate properly. By forcing fruit away from the gap, fruit which is too large will be forced away, thus allowing a space for fruit of the proper size to pass through the gap by gravity.

FIG. 5 shows how the drive pulley 82 is driven by a motor 86 through a gear box 88. FIG. 5 also shows how some of the idler pulleys are larger than others to permit the flexible belt 80 to engage it in parallel courses. The wider pulley may be a single wide pulley with a divider down the middle, or may be two separate pulleys mounted on a common shaft.

For each set of two sizing rollers and two idler pulleys, the belt 80 will enter at a first spacing from the beam 88 and will exit the set displaced by about a belt-width from the first spacing.

It will be noted from FIGS. 4 and 5 that the drive train may be raised or lowered without placing any strain on the drive components because the pulleys, the sizing rollers, and the drive motor are all mounted on the horizontal beam 68. An idler pulley 85, located at the far end of the drive train, is supported on a carriage 90 which is mounted on parallel rods 92 and may be spring-loaded to apply a constant tension to the flexible belt 80.

FIG. 6 shows a second embodiment of a drive train which also allows for raising or lowering of the sizing rollers. This embodiment uses idler pulleys 84, and tension pulley 85 as in the FIG. 4 embodiment. In the FIG. 6 embodiment, the drive pulley 94 may be operated from a line shaft 96, as for example when a plurality of sizers are to be used in series. A takeup pulley 98 is located below the drive pulley 94 and is stationary relative to the drive pulley and both are on the sizer frame. Idler pulleys 84, 85 are on a movable beam such as shown that in FIG. 4. It may be seen that as the beam is raised or lowered, the length of flexible belt 80 will remain constant because any reduction in the distance between the takeup pulley 98 and the first idler pulley will be offset by an increase in distance between the first idler pulley and the drive pulley 94.

Figure 7:
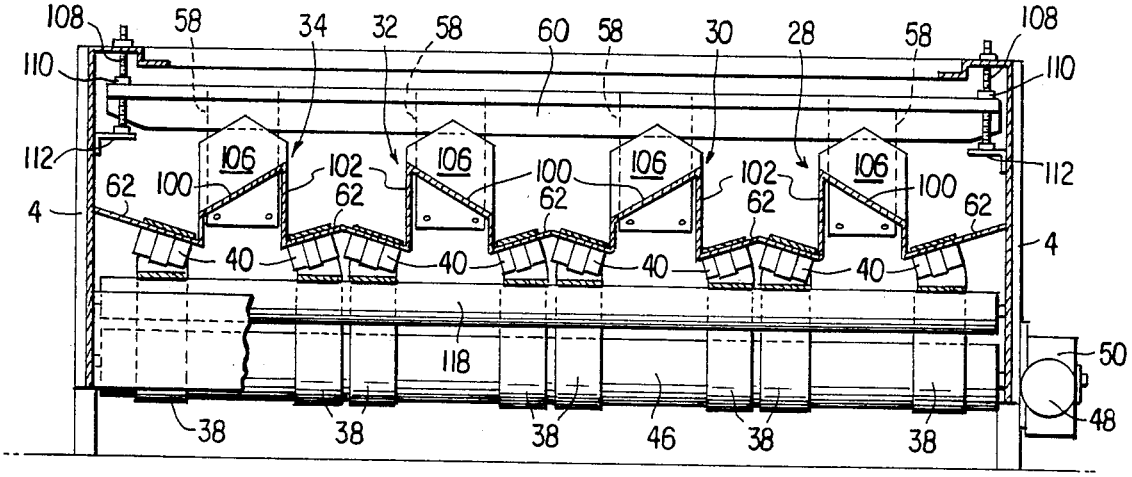
FIG. 7 is a cross-section of the sizer taken along line 7—7 of FIG. 1.

FIG. 7 shows how the in-feed chute is constructed. Each of the dividers, 28–34, includes a surface 100 slanted at about 30 degrees, and a vertical surface 102. These surfaces merge with a slanted surface 104 (which is shown in FIG. 1) to provide the divider function described above with respect to FIG. 1. Protective plates 106 are fixed with respect to the in-feed chute surfaces and prevent the in-coming fruit from interfering with the movement of the beam 60 and the plates 58.

Horizontal beam 60 is mounted on base member 4 by threaded shafts 108 which cooperate with nuts 110 on the beam 60 to raise or lower the beam 60 upon rotation of the shafts. The lower edge of the shafts 108 may rest on brackets 112. This design is similar to that described with respect to FIG. 4.

Figure 8:
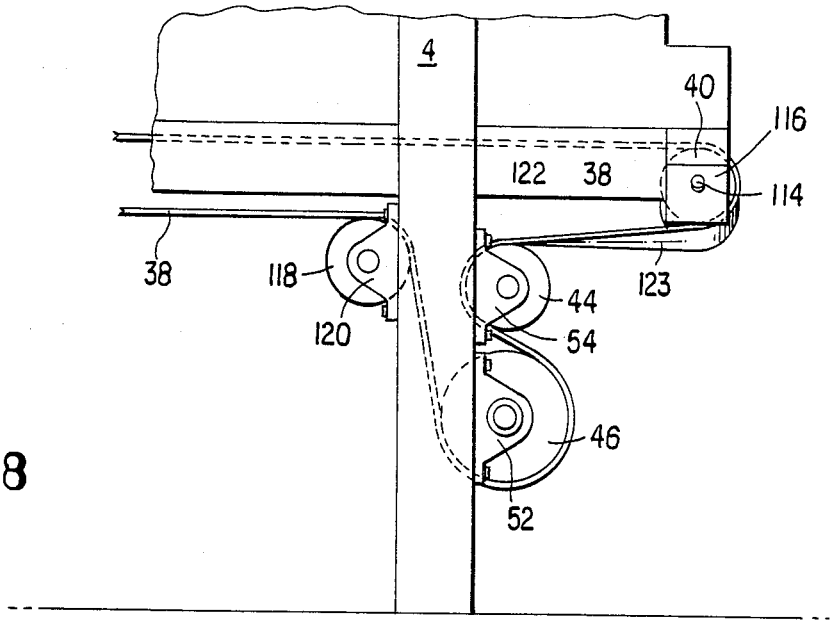
FIG. 8 is a partial cross-section of the drive roller portion of the invention taken along line 8—8 of FIG. 1.

FIG. 8 is a detailed view of the arrangement of rollers which allows the flexible belts 38 to be stressed evenly at each edge to prevent them from being drawn off of the rollers due to the slant of the pans 62. A roller 40 is mounted on a shaft 114, and the shaft is supported on the base 4 by brackets 116. The roller 40 is slanted with respect to the horizontal while rollers 44, 118 and drive roller 46 are mounted horizontally. Roller 118 is mounted with pillow blocks 120 similar to the mounting of roller 44.

The roller 40 is oriented with respect to roller 44 so that the axis of rotation of roller 40 is skew with respect to the axis of rotation of roller 44. Additionally, if one considers a plane defined by the line of tangency 122 of the belt 38 with the roller 44 and a center line 123 of belt 38, one end of the roller 40 and belt 38 is displaced upwardly from that plane by an amount equal to the displacement downwardly of the other end of the roller 40 and belt 38 from that plane. This means that the roller 40 is twisted with respect to the roller 44 in such a manner that one side of the belt 38 is placed in tension because of the upward deflection of a respective end of roller 40 while the other edge of belt 38 is placed under an equal tension due to the downward deflection of the respective end of the roller 40. The center of the belt is under no additional tension because the roller 40 is twisted with respect to the roller 44 about a line 123 containing the center line of belt 38. The rollers 40, 44 are preferably arranged so that line 123 is parallel to the upper course of the belt and is perpendicular to the direction of the axis of roller 44.

The outer surface of rollers 40 and 42 is crowned, for example, by a central ridge, to assist in keeping the belt 38 centered on the rollers.

The arrangement shown in FIG. 8 is highly advantageous since the belt 38 does not have a tendency to move off of the roller 44, and thus the prior art stop which rubs against one edge of the belt is eliminated and with the prior art, the belt scrapes the end of the pan and the machine is longer.

The roller 118 may be oriented with respect to the roller 42, at the far end of the sizer, with the same relationship as between the roller 44 and the roller 40.

Figure 9:
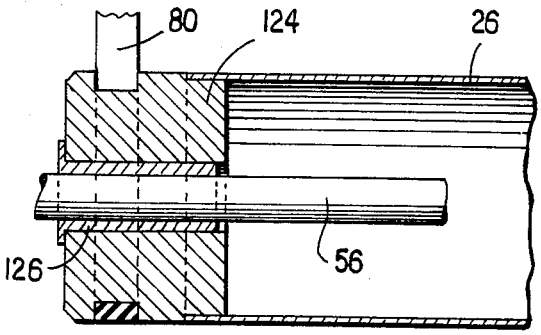
FIG. 9 is a partial cross-section of a sizing roller of the invention taken along line 9—9 of FIG. 3.

FIG. 9 shows an advantageous method for mounting the sizing rollers 26. Shaft 56 is fixed with respect to the end plates 58 and 78. A plug 124 is fitted into the hollow sizing roller 26 and a gushing 126 is fitted into the plug 124. The bushing 126 then provides a lubricated connection with stationary shaft 56 to permit the sizing roller 26 to rotate about the shaft 56. This design is advantageous because the bushing 126 may be relatively long depending upon the length of the sizing roller 26 and the materials used for the elements. In the prior art, the shaft 56 is fixed with respect to the roller 26 and is rotatable with respect to the end plates. The bearings in the end plates are quite small because the end plates are thin and these bearings wore out quickly. The bushing 126 has a much longer lifetime than in the prior art and results also in a smoother operating sizing roller 26.

It is claimed:

1. A sizer of the type having a plurality of parallel paths and size-gauging means associated with said paths, said sizer further comprising a plurality of flexible conveyor belts, each of said flexible conveyor belts being associated with a respective one of said parallel paths, a plurality of first roller means, each of said first roller means being located at an end of a respective said path and engaging a respective said flexible conveyor belt, second roller means for engaging said plurality of flexible conveyor belts, each of said first roller means being mounted for rotation about a respective first axis and said second roller means being mounted for rotation about a second axis which is skew with respect to each said respective first axis, each said first roller means being oriented with respect to said second roller means so that each said flexible conveyor belt extends from a respective said first roller means to said second roller means and is twisted about a centerline of said flexible conveyor belt extending from said respective first roller means to said second roller means to apply equal tension to opposed sides of said flexible conveyor belt, and drive roller means mounted for rotation about a third axis parallel to said second axis for engaging said plurality of flexible conveyor belts and for causing said flexible conveyor belts to move wherein said centerline is parallel to a portion of said flexible conveyor belt extending from said first roller means in the direction of a respective one of said parallel paths, a plurality of pan means, each of said pan means supporting a respective one of said flexible conveyor belts in a portion of a respective one of said parallel paths, each of said pan means being generally planar and lying in a plane parallel to a respective said first axis and further comprising a plurality of third roller means each of said third roller means engaging a respective flexible conveyor belt and being located at an end of a respective said parallel path opposite that of a respective said first roller means, each respective said third roller means being mounted for rotation about a respective third axis which is parallel to a respective said first axis.

2. Apparatus according to claim 1 further comprising fourth roller means for engaging said flexible conveyor belts, said fourth roller means being mounted for rotation about a fourth axis which is parallel to said second and third axes and located between said drive roller means and said plurality of third roller means.

* * * * *